US010434401B2

(12) United States Patent
Hashiba

(10) Patent No.: US 10,434,401 B2
(45) Date of Patent: Oct. 8, 2019

(54) TOY TOP

(71) Applicant: TOMY COMPANY, LTD., Tokyo (JP)

(72) Inventor: Kenta Hashiba, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/892,685

(22) Filed: Feb. 9, 2018

(65) Prior Publication Data

US 2018/0229111 A1 Aug. 16, 2018

(30) Foreign Application Priority Data

Feb. 10, 2017 (JP) ..... 2017-023043

(51) Int. Cl.

| | |
|---|---|
| ***A63F 9/16*** | (2006.01) |
| ***A63H 1/00*** | (2019.01) |
| ***A63H 1/02*** | (2006.01) |
| ***A63H 1/16*** | (2006.01) |
| ***A63F 3/00*** | (2006.01) |

(52) U.S. Cl.

CPC ..... *A63F 9/16* (2013.01); *A63F 3/00895* (2013.01); *A63H 1/00* (2013.01); *A63H 1/02* (2013.01); *A63H 1/16* (2013.01)

(58) Field of Classification Search

CPC ..... A63H 1/04; A63H 1/06; A63H 1/08
See application file for complete search history.

(56) References Cited

U.S. PATENT DOCUMENTS

2002/0102907 A1* 8/2002 Osawa ..... A63H 1/00 446/256
2003/0199222 A1* 10/2003 Matsukawa ..... A63H 1/04 446/256
2009/0253344 A1* 10/2009 Ujita ..... A63H 1/02 446/256

(Continued)

FOREIGN PATENT DOCUMENTS

CN 204699390 U 10/2015
EP 2 377 589 A1 10/2011

(Continued)

OTHER PUBLICATIONS

Office Action for Japanese Patent Application No. 2017-023043, dated Oct. 10, 2017.

(Continued)

*Primary Examiner* — Eugene L Kim
*Assistant Examiner* — Christopher Glenn
(74) *Attorney, Agent, or Firm* — Staas & Halsey LLP

(57) ABSTRACT

A toy top includes a shaft part having, as a shaft center, an axis that coincides with a center of rotation. A lower end portion of the shaft part includes a shaft tip part and an annular member. The shaft tip part includes a contact member. The annular member is movably disposed around the shaft tip part in an extending direction of the axis. In a normal state in which the axis is perpendicular to a contact surface, the contact member protrudes from the annular member downward, and only the contact member contacts (Continued)

the contact surface. When the axis of the shaft part inclines with respect to the contact surface, the contact member and the annular member contact the contact surface.

24 Claims, 9 Drawing Sheets

(56) References Cited

U.S. PATENT DOCUMENTS

2011/0306269 A1* 12/2011 Horikoshi ..... A63H 1/12
446/261
2012/0088433 A1* 4/2012 Choe ..... A63H 1/02
446/256
2014/0302743 A1* 10/2014 Cai ..... A63H 1/18
446/256
2016/0175721 A1* 6/2016 Choi ..... A63H 1/04
446/259

FOREIGN PATENT DOCUMENTS

| | | |
|---|---|---|
| EP | 2 786 790 A1 | 10/2014 |
| JP | 3077133 | 5/2001 |
| WO | 2016/038702 | 3/2016 |

OTHER PUBLICATIONS

Office Action for Japanese Patent Application No. 2017-023043, dated Nov. 28, 2017.
Espacenet English abstract for Chinese Patent Publication No. 204699390 U, published Oct. 14, 2015.
European Office Action dated Aug. 29, 2018 in Application No. 18155968.3.

* cited by examiner

TOY TOP

CROSS-REFERENCE TO RELATED APPLICATIONS

This application is based upon and claims the benefit of priority under 35 USC 119 of Japanese Patent Application No. 2017-023043 filed on Feb. 10, 2017, the entire disclosure of which is incorporated herein by reference in its entirety.

BACKGROUND OF THE INVENTION

1. Field of the Invention

This invention relates to a toy top.

2. Description of the Related Art

There have been proposed ideas for changing the thickness, shape and so forth of a shaft of a toy top that spins on the shaft by rotational force being applied thereto.

For example, there is described in JP 3077133 U a toy top having a cylindrical first revolving shaft and a second revolving shaft arranged in the first revolving shaft at the center of the lower surface of a toy body, wherein when the toy top is spun, the first revolving shaft and the second revolving shaft move relative to each other so that one of the shafts can contact a contact surface.

According to the toy top described in JP 3077133 U, the first revolving shaft and the second revolving shaft having a smaller diameter than the first revolving shaft can be used selectively.

As described therein, changing the thickness, shape, weight and so forth of the shaft of a toy top can change spin characteristics of the toy top.

However, the toy top described in JP 3077133 U has a locking mechanism to take either a state in which the second revolving shaft disappears inside the first revolving shaft or a state in which the second revolving shaft protrudes from the first revolving shaft downward.

Thus, the first revolving shaft and the second revolving shaft are used selectively as a revolving shaft that contacts the contact surface. That is, the toy top is not configured to change its contact state between contacting a contact surface with the first revolving shaft and contacting the contact surface with the second revolving shaft while spinning according to a situation.

However, the condition of a field (contact surface) where toy tops spin may not be uniform. For example, a field may have a portion that is a horizontal (flat) surface and a portion that is an inclined surface.

If a toy top can contact a contact surface only with a revolving shaft selected in advance, the toy top may be unable to deal with the condition of the contact surface appropriately and lose its balance.

SUMMARY OF THE INVENTION

The invention has been conceived in view of the above problems, and objects of the invention include providing a toy top that can keep its balance by flexibly dealing with the condition of a contact surface.

According to an aspect of the invention, there is provided a toy top including: a shaft part having, as a shaft center, an axis that coincides with a center of rotation, wherein a lower end portion of the shaft part includes: a shaft tip part including a contact member; and an annular member disposed around the shaft tip part movably in an extending direction of the axis, in a normal state in which the axis is perpendicular to a contact surface, the contact member protrudes from the annular member downward, and only the contact member contacts the contact surface, and when the axis of the shaft part inclines with respect to the contact surface, the contact member and the annular member contact the contact surface.

BRIEF DESCRIPTION OF THE DRAWINGS

The invention is fully understood from the detailed description given hereinafter and the accompanying drawings, which are given by way of illustration only, and thus are not intended to limit the invention, wherein.

DETAILED DESCRIPTION

Hereinafter, a toy top in accordance with embodiments of the invention are described. These embodiments are provided with a variety of limits that are technically preferable to carry out the invention. However, the scope of the invention is not limited to the following embodiments or illustrated examples.

Overall Configuration

Figure 1A:
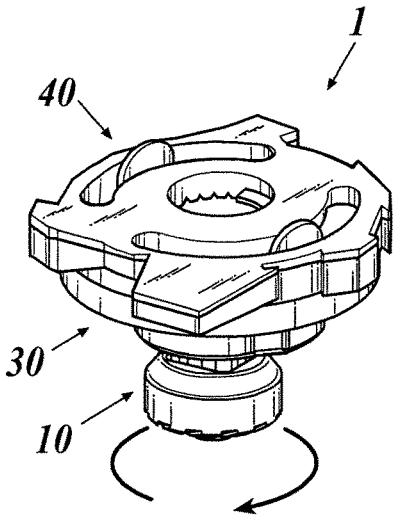
FIG. 1A is a perspective view of a toy top in accordance with an embodiment of the invention.
Figure 1B:
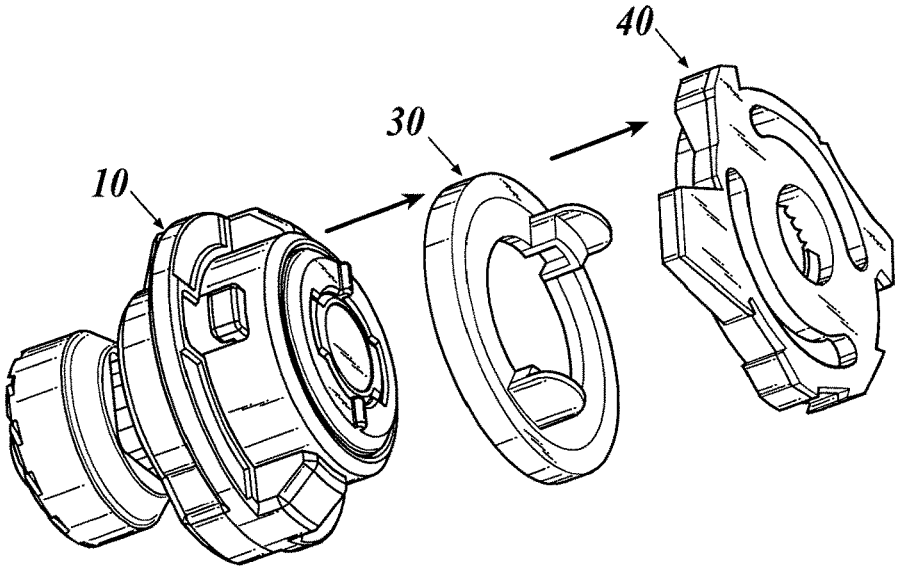
FIG. 1B is a diagram to explain how to play with the toy top of this embodiment.
Figure 2:
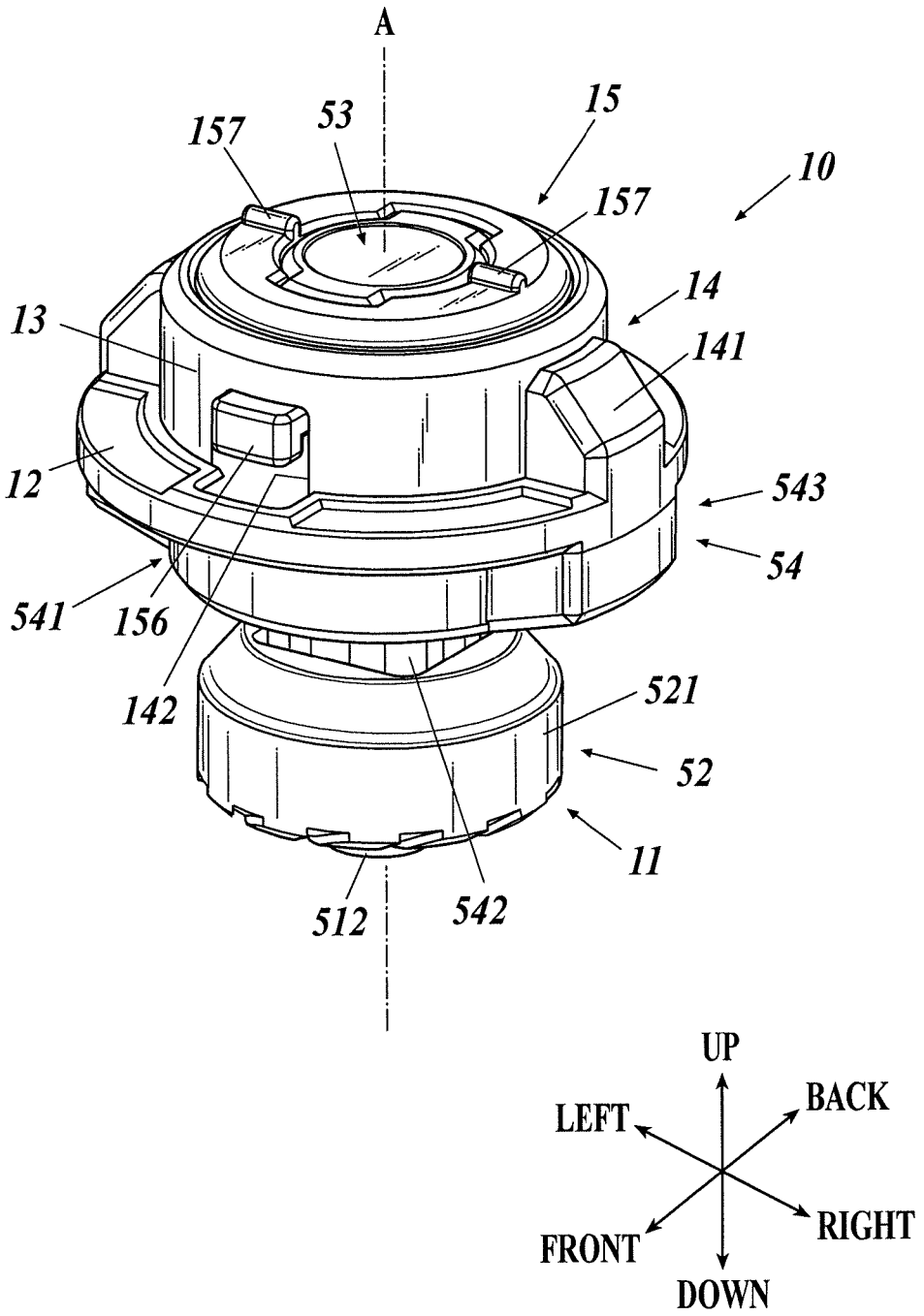
FIG. 2 is a perspective view showing external appearance of a shaft part of the toy top of this embodiment.

FIG. 1A is a perspective view of a toy top in accordance with an embodiment of the invention, FIG. 1B is a diagram to explain how to play with the toy top, and FIG. 2 is a perspective view showing external appearance of a shaft part of the toy top of this embodiment.

The up-down, right-left and front-back directions in this embodiment are as shown in FIG. 2.

A toy top 1 of this embodiment is a toy top that can be used for, what is called, a top battle game.

More specifically, this toy top 1 can be used for a battle game, wherein the toy top 1 can win the game by disassembling an opponent toy top 1 as shown in FIG. 1B by impact generated by collision of the toy tops 1.

The toy top 1 is constituted of, as shown in FIG. 1B, a shaft part 10 that constitutes the lower structure, a performance changeable ring 30 and a body 40 which form a layer that constitutes the upper structure.

Detailed Configuration of Shaft Part

Figure 3A:
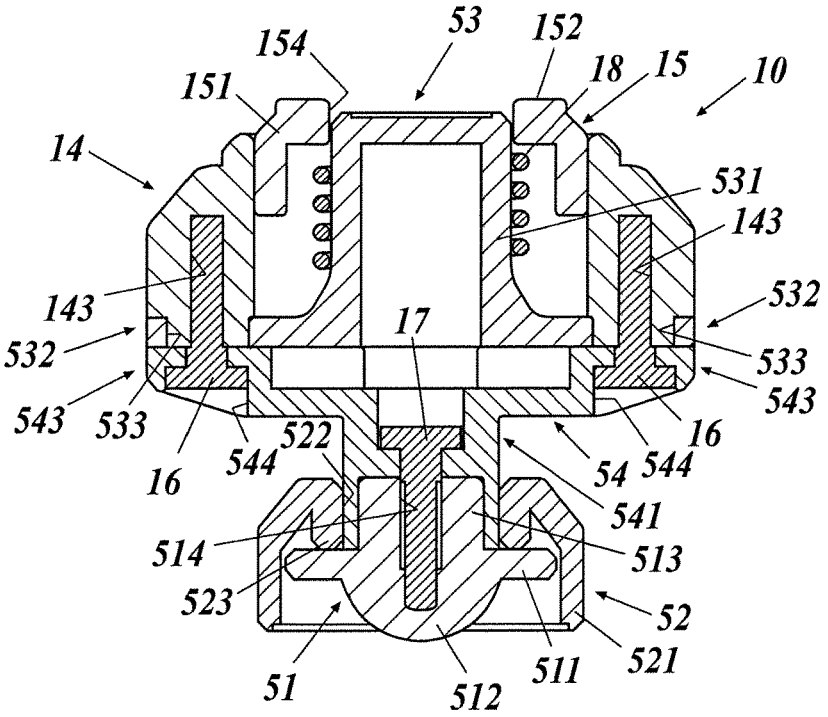
FIG. 3A is a cross-sectional view of the shaft part of the toy top of this embodiment cut in the right-left direction.
Figure 3B:
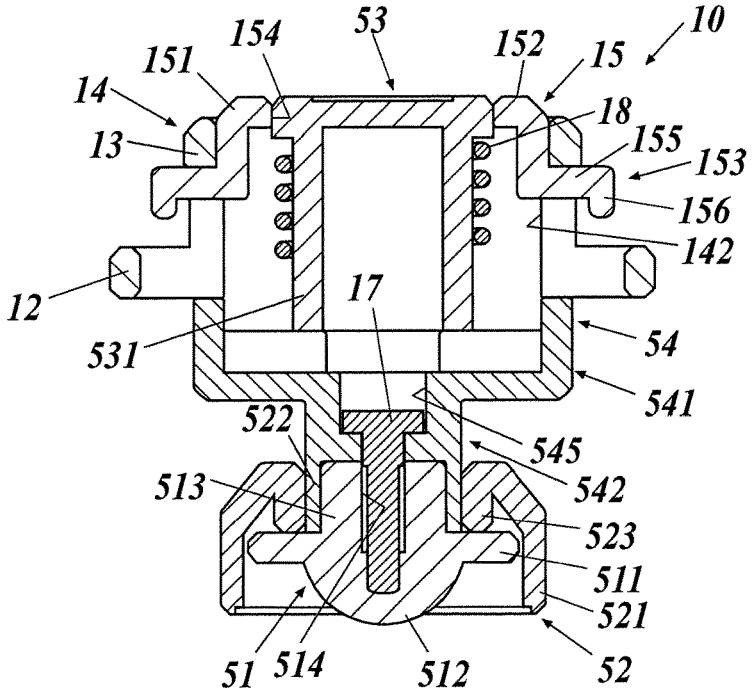
FIG. 3B is a cross-sectional view of the shaft part of this embodiment cut in the front-back direction.

FIG. 3A is a cross-sectional view of the shaft part 10 of the toy top 1 of this embodiment cut in the right-left direction shown in FIG. 2, and FIG. 3B is a cross-sectional view of the shaft part 10 of the toy top 1 of this embodiment cut in the front-back direction shown in FIG. 2.

Figure 4:
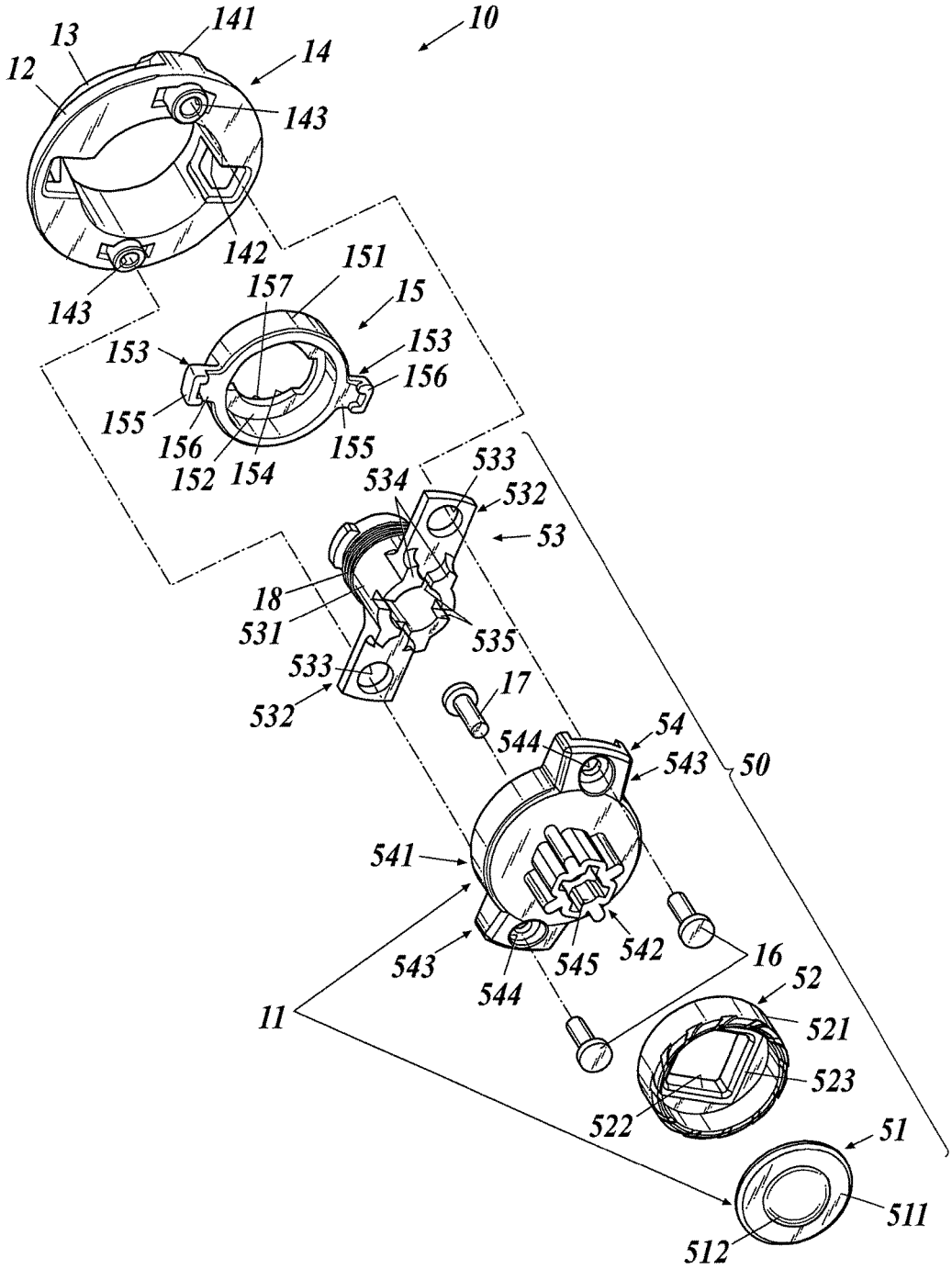
FIG. 4 is an exploded perspective view of the shaft part of the toy top.

FIG. 4 is an exploded perspective view of the shaft part 10 of this embodiment.

As shown in FIG. 2, the shaft part 10 has, as a shaft center (i.e. center of the shaft part 10), an axis A that coincides with a center of rotation of the toy top 1, and a lower end portion of the shaft part 10 includes a shaft tip part 11, a middle portion in the up-down direction of the shaft part 10 includes a flange part 12, and an upper end portion of the shaft part 10 includes a cylindrical part 13.

In this embodiment, as shown in FIG. 4, the flange part 12 and the cylindrical part 13 are integrated and formed as an upper case 14, and constitute a top portion of the shaft part 10.

As shown in FIG. 2 and FIG. 4, the cylindrical part 13 and the flange part 12 of the upper case 14 are provided with two protruding parts 141 at points opposite to each other across the axis of the shaft part 10 in the right-left direction. Outer surfaces of these protruding parts 141 are substantially flush with an outer circumferential surface of the flange part 12.

As shown in FIG. 3B and FIG. 4, the cylindrical part 13 and the flange part 12 of the upper case 14 are also provided with two cuts 142 at points opposite to each other across the axis A of the shaft part 10 in the front-back direction. The cuts 142 extend along the axis of the shaft part 10.

The shaft part 10 includes a pressure member 15 formed to be approximately cylindrical. In this embodiment, the pressure member 15 is formed of synthetic resin, but may be formed of metal or another material.

Figure 5A:
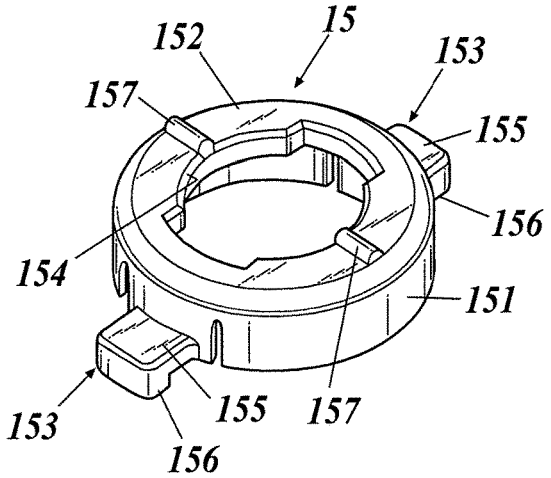
FIG. 5A is a perspective view of a pressure member of the toy top.

FIG. 5A is a perspective view of the pressure member 15 viewed obliquely from the above.

As shown in FIGS. 3A, 3B, 4 and 5A, the pressure member 15 includes a cylindrical part 151, a ceiling part 152 and leg parts 153.

An outer diameter of the cylindrical part 151 is smaller than an inner diameter of the cylindrical part 13 of the upper case 14, and in an assembled state, the cylindrical part 151 of the pressure member 15 is disposed in the cylindrical part 13 of the upper case 14.

An inner diameter of the cylindrical part 151 is larger than an outer diameter of an upper end portion of a columnar member 53 of a shaft body 50, which are described below, so that the upper end portion of the columnar member 53 is fitted in the cylindrical part 151.

The ceiling part 152 is disposed on an upper end of the cylindrical part 151. In this ceiling part 152, an opening 154 having a shape corresponding to a shape of the upper end portion of the columnar member 53 is formed.

The leg parts 153 are disposed on a lower end portion of an outer circumference of the cylindrical part 151.

These two leg parts 153 are formed, on the outer circumference of the cylindrical part 151, at points opposite to each other across the axis A of the shaft part 10 in the front-back direction. Each leg part 153 includes a horizontal part 155 that projects horizontally from the cylindrical part 151 and a vertical part 156 that extends vertically downward from a tip of the horizontal part 155.

The thus-configured pressure member 15 is placed such that the leg parts 153 are inserted through the cuts 142 of the upper case 14 in the assembled state. Dimensions of the cuts 142 in the up-down direction are set to be larger than dimensions of the leg parts 153 in the up-down direction. The pressure member 15 is movable in the up-down direction along the axis A of the shaft part 10 by the leg parts 153 being guided in the up-down direction in the cuts 142.

This pressure member 15 is biased upward by a spring 18 located on a neck 531 of the column member 53. Upward movement of the pressure member 15 is restricted by the leg parts 153 bumping against upper edges of the cuts 142. In the normal state, an upper end of the pressure member 15 and an upper end of the cylindrical part 13 of the upper case 14 are approximately at the same height.

On an upper surface of the ceiling part 152 of the pressure member 15, two ridges (protrusions) 157 that extend in the radius direction are formed at points opposite to each other across the axis A of the shaft part 10 in the right-left direction.

Under the upper case 14, the shaft body 50 (shown in FIG. 4) having the axis A that coincides with the center of rotation of the toy top 1 as the shaft center is disposed.

Figure 6A:
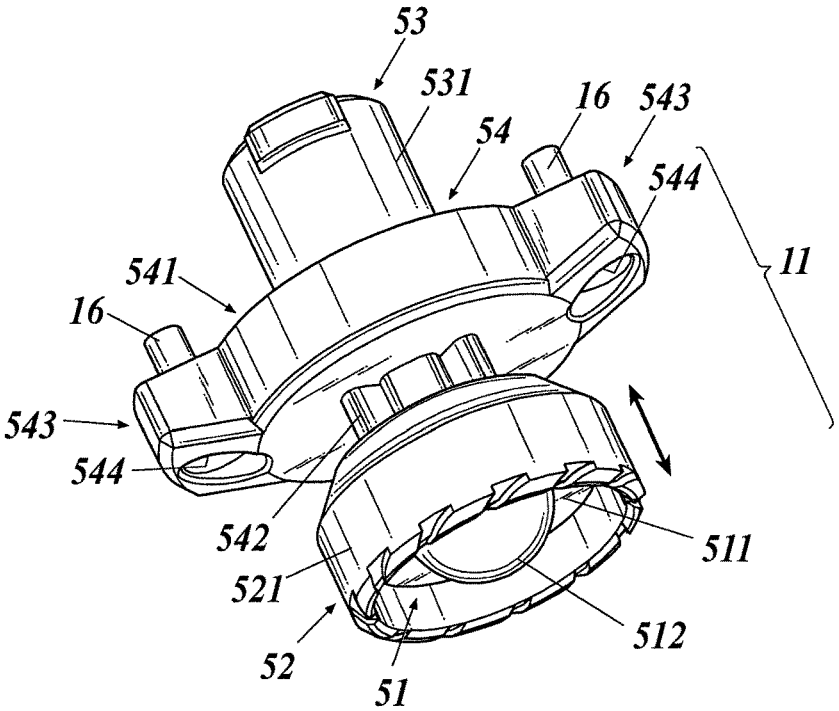
FIG. 6A is a perspective view of a shaft body of the toy top.
Figure 6B:
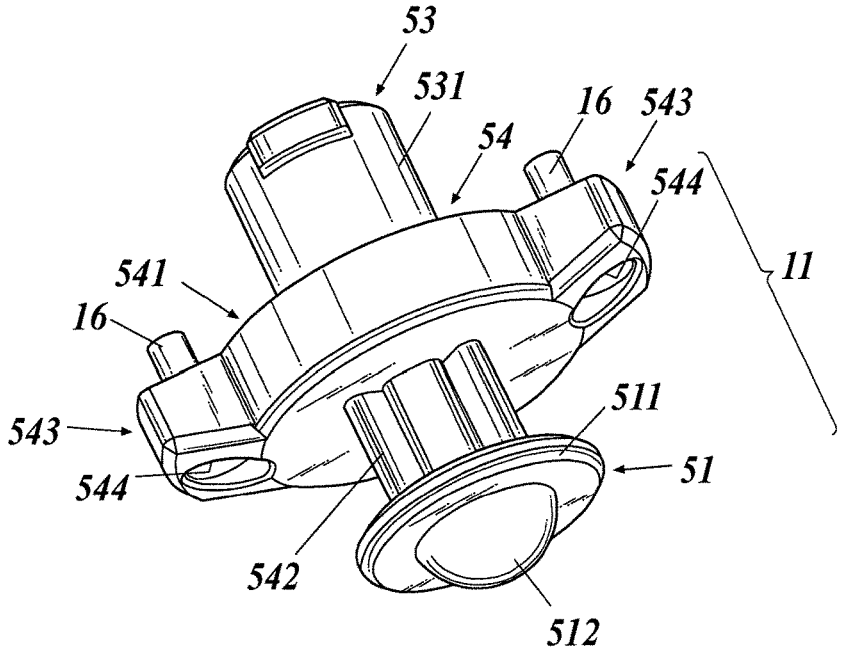
FIG. 6B is a perspective view showing a state in which an annular member is removed from the shaft body shown in FIG. 6A.

FIG. 6A is a perspective view of the shaft body 50, and FIG. 6B is a perspective view showing an inner configuration of the shaft body 50, shown in FIG. 6A, from which an annular member 52 is removed.

As shown in FIGS. 4, 6A and 6B, the shaft body 50 includes the shaft tip part 11, the annular member 52 and the columnar member 53.

In this embodiment, the lower end portion of the shaft part 10 includes the shaft tip part 11 and the annular member 52.

As shown in FIG. 4, the shaft tip part 11 includes a contact member 51 and a support member 54 that supports the contact member 51.

Figure 5B:
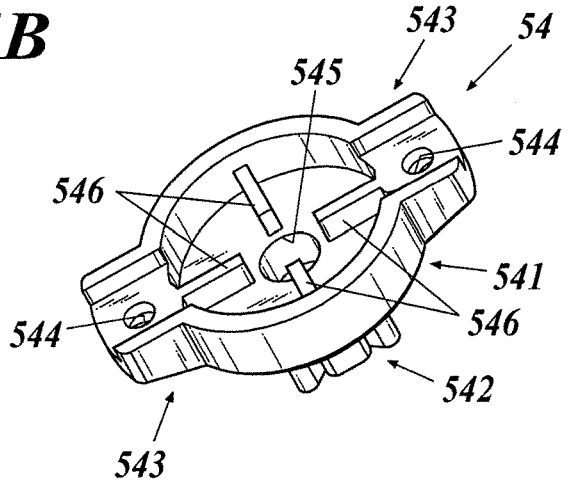
FIG. 5B is a perspective view of a support member of the toy top.
Figure 5C:
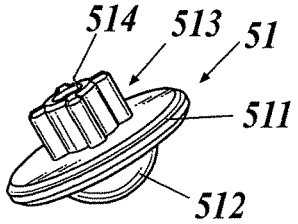
FIG. 5C is a perspective view of a contact member of the toy top viewed from a side.
Figure 5D:
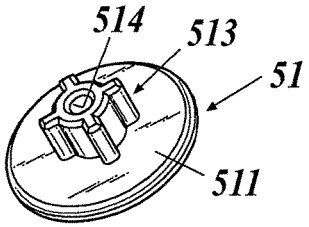
FIG. 5D is a perspective view of the contact member of the toy top viewed obliquely from the above.

FIG. 5C is a perspective view of the contact member 51 viewed from a side, and FIG. 5D is a perspective view of the contact member 51 viewed obliquely from the above.

As shown in FIGS. 5C and 5D, the contact member 51 of this embodiment includes a disc-shaped locking part 511 and an arc-shaped part 512 that protrudes from the locking part 511 downward.

The arc-shaped part 512 of the contact member 51 is a part that directly contacts a field or the like during play with the toy top 1, is approximately hemispherical and protrudes from the locking part 511 downward. The arc-shaped part 512 is disposed such that its most protruding portion, namely, the apex portion, is located on the axis A of the shaft part 10.

On an upper side of the locking part 511 (i.e. the side opposite to the side where the arc-shaped part 512 is formed), a connecting shaft part 513 that protrudes along the extending direction of the axis of the shaft part 10 and is connected with the support member 54 is disposed.

A cross-sectional shape of the connecting shaft part 513 in a direction orthogonal to the axis A corresponds to a cross-sectional shape of a connecting shaft part 542 in the direction orthogonal to the axis, and the connecting shaft part 513 is fitted with the connecting shaft part 542 of the support member 54. In this embodiment, the cross-sectional shape of the connecting shaft part 513 is approximately the shape of "X".

At the shaft center of the connecting shaft part 513, a hole 514 formed along an extending direction of the axis A of the shaft part 10 is formed. As shown in FIGS. 3A, 3B and 4, into the hole 514, a screw 17 is inserted.

The contact member 51 may be formed of metal or another material (e.g. hard resin).

The support member 54 supports the contact member 51, and constitutes the shaft tip part 11 together with the contact member 51.

FIG. 5B is a perspective view of the support member 54 viewed obliquely from the above.

As shown in FIGS. 3A, 3B, 4 and 5B, the support member 54 includes a columnar part 541, an upper end portion of which is open, and a pair of projecting parts 543 that project from an outer circumference of the columnar part 541 outward. In each projecting part 543, a through hole 544 is formed. Each through hole 544 is formed at a point that corresponds to a through hole 533 formed on lateral projections 532 of the columnar member 53 and a hole 143 of the upper case 14 in the assembled state.

As shown in FIG. 4, the upper case 14, the columnar member 53, the support member 54 and the pressure member 15 that is disposed between the upper case 14 and the columnar member 53 are fixed and integrated by screws 16 inserted through the through holes 544 and the through holes 533 and into the holes 143.

On A lower surface of the columnar part 541 of the support member 54, the connecting shaft part 542, that protrudes along the extending direction of the axis A of the shaft part 10 and is connected with the connecting shaft part 513 of the contact member 51, is disposed.

The connecting shaft part 542 of this embodiment is a shaft part that is hollow and has an odd cross-sectional shape, and into the hollow portion, the connecting shaft part 513 of the contact member 51 is fitted.

The cross-sectional shapes of the connecting shaft part 542 and the corresponding connecting shaft part 513 of the contact member 51 are not limited to the illustrated examples, but preferably odd or polygonal, not circular, in order to restrict the contact member 51 and the support member 54, or the shaft tip part 11, which is constituted of the contact member 51 and the support member 54, and the below-described annular member 52 from rotating freely in relation to each other.

At the shaft center of the connecting shaft part 542, a through hole 545 formed along the extending direction of the axis of the shaft part 10 is formed. As shown in FIGS. 3A, 3B and 4, into the through hole 545, the screw 17 is inserted.

On an inner side (upper side) of a bottom surface of the columnar part 541 of the support member 54, four ribs 546 are disposed radially. The positions and shapes (thicknesses) of the ribs 546 correspond to the positions and widths of gaps 535 formed between ribs 534 disposed on the lower end portion of the columnar member 53, and the ribs 546 of the support member 54 are fitted in the gaps 535 between the ribs 534 of the columnar member 53 in the assembled state.

The annular member 52 is disposed around the shaft tip part 11 movably in the extending direction of the axis A of the shaft part 10.

The annular member 52 of this embodiment includes a cylindrical part 521 that constitutes an outer circumference of the annular member 52.

In this embodiment, an inner diameter of the cylindrical part 521 of the annular member 52 is larger than a diameter of the disc-shaped locking part 511 of the contact member 51. As shown in FIGS. 3A and 3B, the contact member 51 can be housed in the cylindrical part 521 of the annular member 52.

In this embodiment, in an upper-side end surface of the cylindrical part 521, an opening 522 is formed. The connecting shaft part 542 of the support member 54 fitted with the connecting shaft part 513 of the contact member 51 is inserted through the opening 522. The annular member 52 can slide along the connected shaft parts 542, 513 up and down along the axis A.

In this embodiment, the opening 522 is formed to be approximately square, and, by inserting the connecting shaft opening part 542, which is formed to be odd-shaped, through the opening 522, rotary action of the annular member 52 in a circumferential direction is restricted.

The annular member 52 includes a rib 523 drooping vertically from the opening edge of the opening 522.

As shown in FIGS. 3A and 3B, a tip of the rib 523 can abut an upper surface of the locking part 511 of the contact member 51 housed in the cylindrical part 521. This prevents the annular member 52 from falling off the locking part 511 of the contact member 51.

Assembling Method

Next, an example of a method for assembling the toy top 1 is described. Hereinafter, assembling of the shaft part 10 is described mainly.

First, the connecting shaft part 542 of the support member 54 of the shaft tip part 11 is inserted through the opening 522 of the annular member 52. Then, the contact member 51 is placed in the cylindrical part 521 of the annular member 52 from underneath such that the connecting shaft part 513 faces up, and is fitted with the connecting shaft part 542 of the support member 54.

Then, from above the support member 54, the screw 17 is inserted through the through hole 545 provided at the shaft center of the connecting shaft part 542 and turned until a tip portion of the screw 17 reaches the inside of the hole 514 provided at the shaft center of the connecting shaft part 513 of the contact member 51, so that the support member 54 is fixed to and integrated with the contact member 51. This puts the annular member 52 in a state in which the connecting shaft part 542 is inserted through the annular member 52.

Next, the columnar member 53 is attached to the support member 54 such that the side where the ribs 534 are disposed faces down. More specifically, the ribs 546 of the support member 54 are fitted into the gaps 535 between the ribs 534 of the columnar member 53.

Then, the pressure member 15 is fitted to the upper end portion of the columnar member 53 such that the shape of the opening 154 corresponds to a shape of the upper end portion of the columnar member 53.

Then, the pressure member 15 is covered with the upper case 14 from above, and the screws 16 are inserted from underneath the support member 54 through the through holes 544 of the support member 54 and the through holes 533 of the columnar member 53, and tip portions of the screws 16 are installed in the holes 143 of the upper case 14.

In this manner, all the components constituting the shaft part 10 are integrated, and assembling of the shaft part 10 finishes.

On an upper portion of the thus-assembled shaft part 10, the performance changeable ring 30 is mounted to be in a fitted state.

The resulting product is mounted on the body 40 from underneath to be in a locked state, so that the body 40 and the performance changeable ring 30 cannot be easily detached from the shaft part 10.

In this manner, assembling of the toy top 1 in this embodiment is finished.

How to Play and Actions

Next, an example of how to play with the toy top 1 and actions of the toy top 1 are described.

In this example of how to play with the toy top 1, the toy top 1 is spun and fights against an opponent toy top 1.

For that, a not-shown launcher or the like is used to supply rotational force to the toy top 1, thereby spinning and launching the toy top 1 to a predetermined field.

The thus-launched toy top 1 spins on the field, and when the toy top 1 and the opponent toy top 1 collide with each other, the impact force or the like provided by the collision acts on the toy tops 1. When one of the toy tops 1 is put in an unlocked state by repeated collision, that toy top 1 is disassembled into the shaft part 10, the performance changeable ring 30 and the body 40 as shown in FIG. 1B.

Figure 7A:
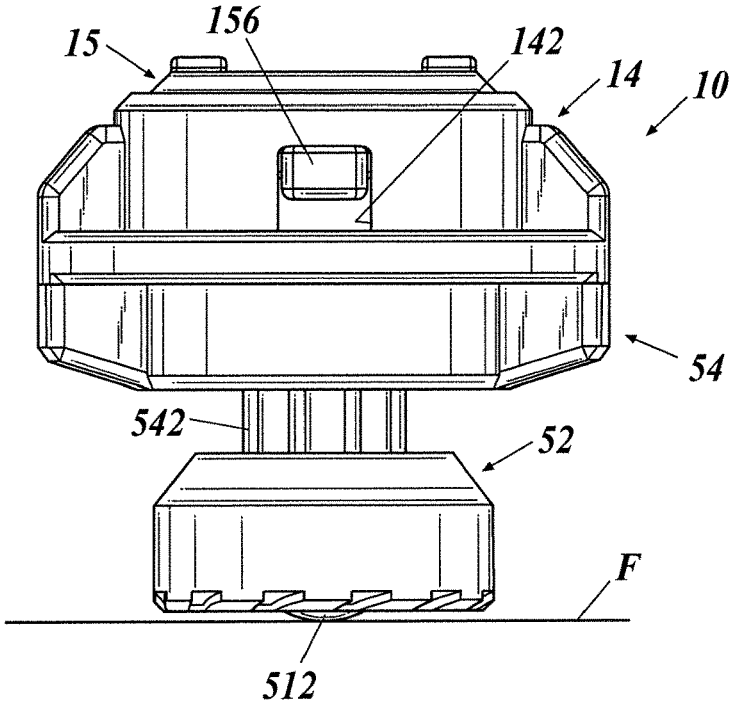
FIG. 7A is a lateral view showing a contact state in the normal state in which an axis of the shaft part does not incline.
Figure 9A:
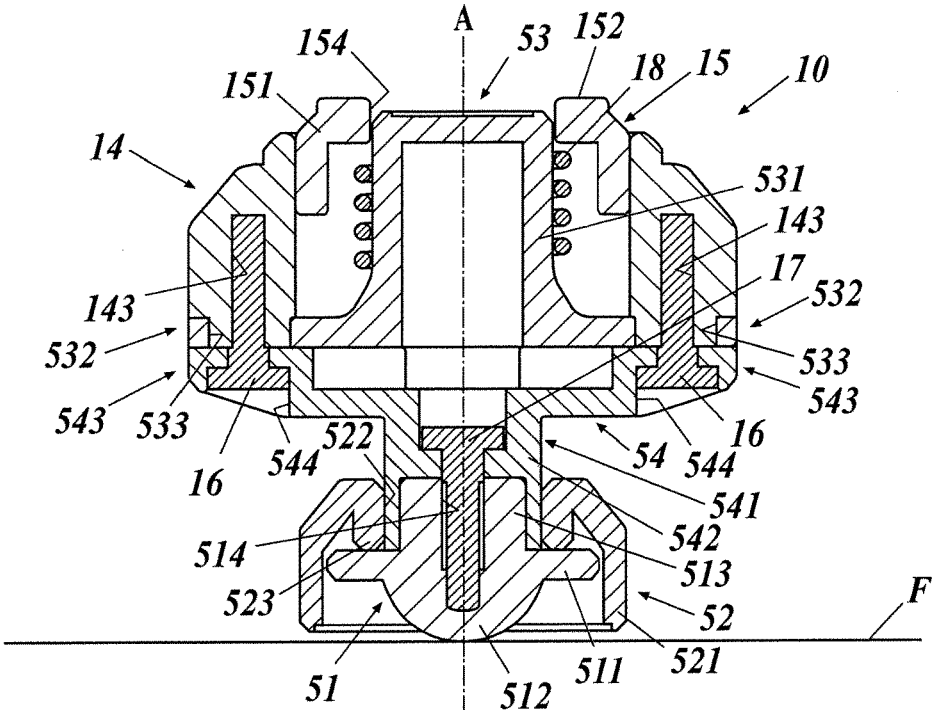
FIG. 9A is a cross sectional view of FIG. 7A and shows the position of the annular member in the normal state, in which the axis does not incline.

In this embodiment, as shown in FIGS. 7A and 9A, in the normal state, in which the axis A of the shaft part 10 of the toy top 1 is perpendicular to a contact surface, such as a field F, the contact member 51 (in this embodiment, the arc-shaped part 512 on the lower end portion of the contact member 51) protrudes from the annular member 52 downward, so that only the contact member 51 (in this embodiment, the arc-shaped part 512) contacts the contact surface, such as the field F.

Thus, the toy top 1 can spin stably.

Figure 7B:
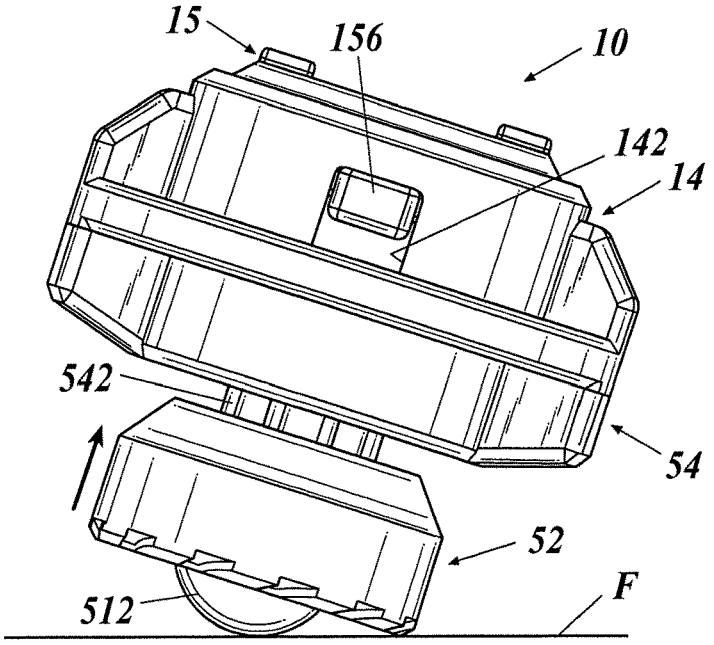
FIG. 7B is a lateral view showing a state in which the axis of the shaft part inclines and the contact member and the annular member both contact a contact surface.
Figure 9B:
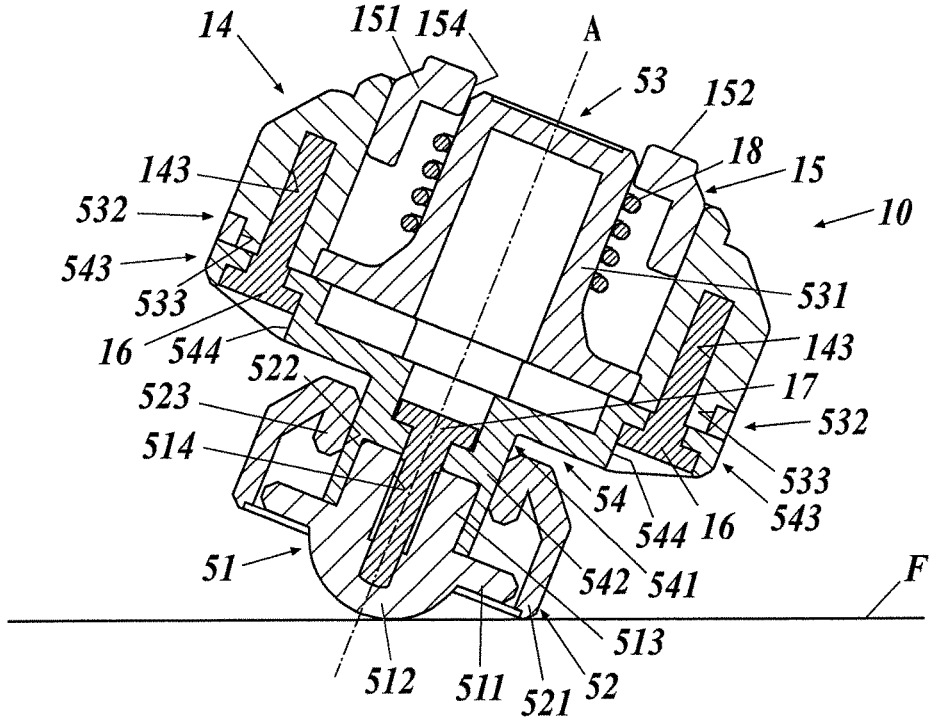
FIG. 9B is a cross sectional view of FIG. 7B and shows movement of the annular member from the position shown in FIG. 9A when the axis inclines.

On the other hand, as shown in FIGS. 7B and 9B, when the rotational force of the toy top 1 decreases and accordingly the axis A of the shaft part 10 of the toy top 1 inclines with respect to the contact surface, such as the field F, in the horizontal condition, or when the toy top 1 runs on the field F or the like (contact surface) that inclines by colliding with an opponent toy top 1, thereby being sent flying or the like, and accordingly the axis of the shaft part 10 inclines with respect to the contact surface, not only the contact member 51 (in this embodiment, the arc-shaped part 512) but also the annular member 52 contacts the field F or the like (contact surface).

Thus, the toy top 1 can be supported at two points, namely, by the contact member 51 (in this embodiment, the arc-shaped part 512) and the annular member 52. Hence, the toy top 1 can be easily balanced, and can spin relatively stably even when the axis A of the shaft part 10 inclines.

Further, the inclining toy top 1 can be brought back to the normal state by the annular member 52 pushing against the contact surface. That is when contacting the field F or the like (contact surface), the annular member 52 moves up and down along the axis A of the shaft part 10 by receiving external force generated by the contact with the contact surface. This can effectively absorb the impact transmitted to the shaft part 10. Thus, the toy top 1 can spin more stably.

When contacting the field F or the like (contact surface), the annular member 52 is pushed upward along the axis A of the shaft part 10 by receiving external force generated by the contact with the contact surface. Compare FIGS. 6A, 7A and 7B. The annular member 52 does not go too high and fly away owing to friction resistance generated by the contact with the contact surface, and keeps supporting the toy top 1.

In this embodiment in particular, because rotary action of the annular member 52 in the circumferential direction of the axis of the shaft part 10 is restricted, the friction resistance when the annular member 52 contacts the contact surface is larger than that of an annular member configured to be freely rotatable in the circumferential direction of its axis.

Hence, the annular member 52 contacts the contact surface at an appropriate position and supports the toy top 1, and also, by pushing against the contact surface, generates force acting on the inclining toy top 1 to return to the normal state. Thus, the toy top 1 falls over less easily and can keep spinning stably for a long period of time.

Advantageous Effects

As described above, according to this embodiment, in the normal state, in which the axis A of the shaft part 10 does not incline with respect to the contact surface, the contact member 51 protrudes from the annular member 52 downward, and only the contact member 51 contacts the contact surface, so that the toy top 1 can spin smoothly. On the other hand, when the axis of the shaft part 10 inclines with respect to the contact surface, the contact member 51 and the annular member 52 both contact the contact surface, so that the toy top 1 can be supported by both of the contact member 51 and the annular member 52 in a direction to return to the state (normal state) in which the axis A of the shaft part 10 does not incline from the state in which the axis of the shaft part 10 inclines, and accordingly can return the spinning posture to the normal state. Thus, the toy top 1 can be a toy top that does not fall over easily.

Further, the annular member 52, which moves up and down between the contact member 51 and the support member 54, along the extending direction of the axis A, contacts the contact surface together with the contact member 51 when the axis of the shaft part 10 inclines with respect to the contact surface. Hence, it can also be expected that the impact transmitted to the shaft part 10 is absorbed effectively by the up and down movement of the annular member 52.

Thus, the toy top 1 of this embodiment can keep its balance by flexibly dealing with the condition of the contact surface.

Further, when the axis of the shaft part 10 inclines with respect to the contact surface, the annular member 52 moves up and down along the extending direction of the axis by being pushed by the contact surface. However, because rotary action of the annular member 52 of this embodiment in the circumferential direction of the shaft tip part 11 is restricted, large friction resistance is generated between the annular member 52 and the contact surface. This prevents the annular member 52 from moving up and down excessively along the extending direction of the axis, and the annular member 52 contacts the contact surface at an appropriate position together with the contact member 51.

Thus, the toy top 1 can keep its balance using the ring-shape member 52 as a support, and the inclining toy top 1 can be brought back to the normal state.

Modifications

Although an embodiment of the invention is described above, it goes without saying that the invention is not limited thereto and can be modified in a variety of aspects without departing from the gist.

For example, in the above embodiment, the contact member 51 has the hemispherical arc-shaped part 512, and this arc-shaped part 512 contacts the field F. However, the shape of the contact member 51 that contacts the field F is not particularly limited. For example, the tip portion of the shaft part 10, contacting the field F, may be cone-shaped, bar-shaped or the like.

Even if the contacting part of the contact member 51 is not arc-shaped, the annular member 52 contacts the contact surface together with the contact member 51 when the shaft part 10 inclines, so that the toy top 1 can be supported stably at two points and accordingly can be a toy top that does not fall over easily and can spin stably, as with the contact member 51 having the arc-shaped contacting part.

Figure 8A:
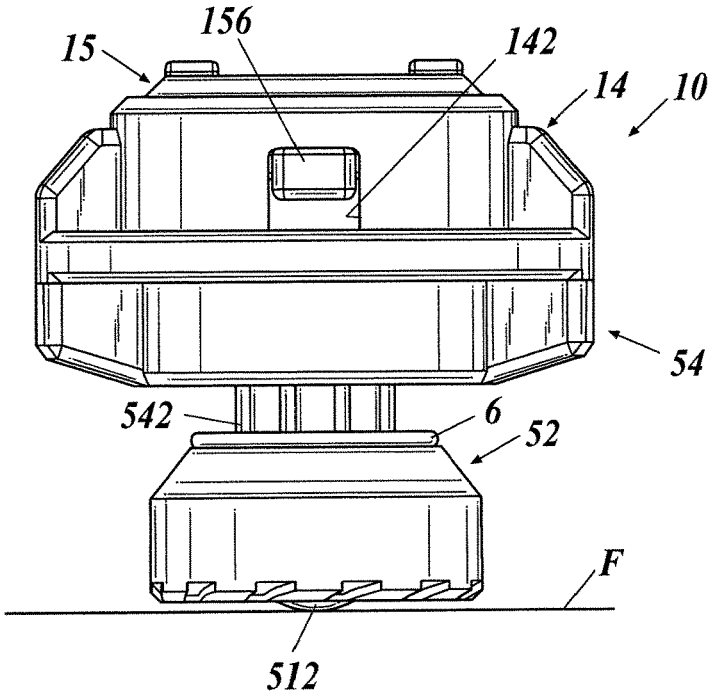
FIG. 8A is a lateral view of the shaft part including the annular member provided with a weight in accordance with a modification from the embodiment.

Further, as shown in FIG. 8A, the annular member 52 may be provided with a weight 6 to be added to the weight of the annular member 52.

The weight 6 to be added to the weight of the annular member 52 so as to push the annular member 52 toward the lower end of the shaft part 10 effectively prevents the annular member 52 from floating up (moving in the up direction, which follows the extending direction of the axis) when the annular member 52 contacts the contact surface. Hence, the toy top 1 can keep its balance more stably in the state in which the contact member 51 and the annular member 52 both contact the contact surface.

The weight 6 may be replaceable. In this case, a user can freely customize his/her toy top 1, for example, by adjusting the amount (weight) of the weight 6 according to the condition of the field F, how to fight and/or the like. This increases enjoyment of playing with the toy top 1.

Figure 8B:
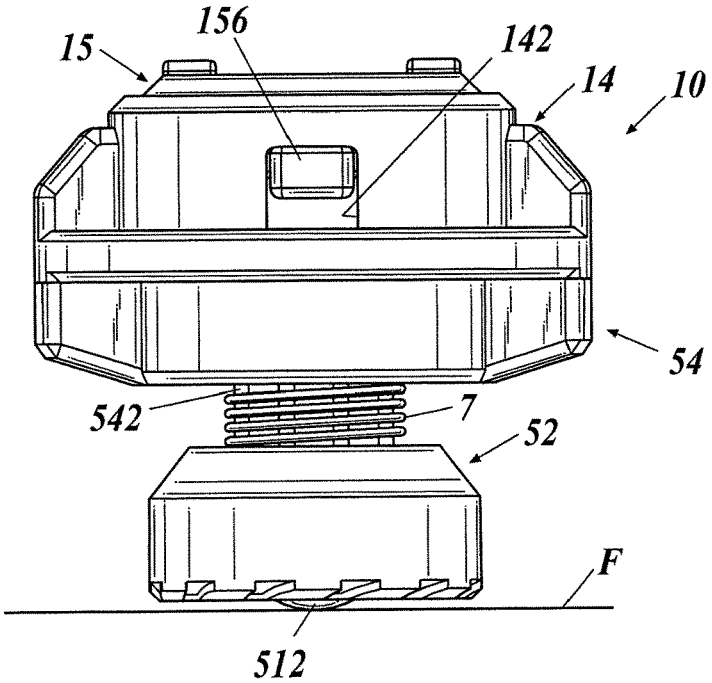
FIG. 8B is a lateral view of the shaft part including a bias member that biases the annular member toward the lower end of the shaft part in accordance with another modification from the embodiment.

Further, for example, as shown in FIG. 8B, a spring 7 may be provided as a bias member that biases the annular member 52 toward the lower end of the shaft part 10.

The bias member (spring 7) that biases the annular member 52 toward the lower end of the shaft part 10 prevents the annular member 52 from floating up (moving in the up direction, which follows the extending direction of the axis) when the annular member 52 contacts the contact surface. Hence, the toy top 1 can easily maintain the state in which the contact member 51 and the annular member 52 both contact the contact surface, and can keep its balance more stably.

The bias member is not limited to the spring 7 and may be any component as far as it can bias the annular member 52 toward the lower end of the shaft part 10.

Further, in this embodiment, the cross-sectional shapes of the connecting shaft part 542 of the support member 54 and its corresponding connecting shaft part 513 of the contact member 51 are odd-shaped, the opening 522 of the annular member 52 is formed to be approximately square, and rotary action of the annular member 52 in the circumferential direction is restricted by the odd-shaped connecting shaft part 542 being inserted through the square opening 522. However, the cross-sectional shapes of the connecting shaft part 542 of the support member 54 and the connecting shaft part 513 of the contact member 51 and the shape of the opening 522 of the annular member 52 are not limited to those described herein or shown in the drawings.

For example, the cross-sectional shapes of the connecting shaft part 542 of the support member 54 and the connecting shaft part 513 of the contact member 51 and the shape of the opening 522 of the annular member 52, which is fitted with the connecting shaft part 542 and the connecting shaft part 513, may be formed to be circular so that rotation of the annular member 52 in the circumferential direction is not restricted.

In this case too, when the annular member 52 contacts the contact surface, friction resistance is generated. Hence, the same advantageous effects as those of the above embodiment can be expected.

As described above, according to an aspect of the invention, there is provided a toy top including: a shaft part having, as a shaft center, an axis that coincides with center of rotation, wherein the lower end portion of the shaft part includes: a shaft tip part including a contact member; and an annular member disposed around the shaft tip part movably in the extending direction of the axis, in the normal state in which the axis is perpendicular to a contact surface, the contact member protrudes from the annular member downward, and only the contact member contacts the contact surface, and when the axis of the shaft part inclines with respect to the contact surface, the contact member and the annular member contact the contact surface.

Accordingly, in the normal state, the contact member protrudes from the annular member downward and contacts the contact surface, so that the toy top can spin smoothly, and when the axis of the shaft part inclines with respect to the contact surface, the annular member contacts the contact surface together with the contact member. Thus, the toy top can keep its balance by flexibly dealing with the condition of the contact surface.

Further, although when the axis of the shaft part inclines with respect to the contact surface, the annular member moves up and down along the extending direction of the axis by being pushed by the contact surface, friction resistance is generated between the annular member and the contact surface. This prevents the annular member from moving up and down excessively along the extending direction of the axis, and the annular member contacts the contact surface at an appropriate position together with the contact member. Thus, the toy top can keep its balance.

What is claimed is:

1. A toy top comprising:

a shaft part having, as a shaft center, an axis that coincides with a center of rotation of the toy top, wherein a lower end portion of the shaft part includes: a shaft tip part including a contact member; a support member non-movably fixed to the lower end portion of the shaft part and disposed on an upper side of the contact member, wherein the contact member is non-movably fixed to the support, and an annular member disposed around the shaft tip part in an extending direction of the axis, and while the toy top is spinning, in a normal state in which the axis is perpendicular to a contact surface, the contact member protrudes from the annular member downward, and only the contact member contacts the contact surface, when the axis of the shaft part inclines with respect to the contact surface, the contact member and the annular member contact the contact surface, and when the annular member contacts the contact surface, the annular member moves up toward the support member along the axis of the shaft part.

2. The toy top according to claim 1, further comprising a bias member that biases the annular member toward a lower end of the shaft part.

3. The toy top according to claim 1, wherein the annular member is provided with a weight.

4. The toy top according to claim 2, wherein the annular member is provided with a weight.

5. A toy top for spinning on a surface, comprising: a shaft part having an axis that coincides with a center of rotation of the toy top, wherein the shaft part has a first end and a second end, a shaft tip at the first end, a body at the second end, a support member non-movably fixed to the shaft part and disposed on an upper end of the shaft tip, wherein the shaft tip is non-movably fixed to the support, and an annular member is positioned between the shaft tip and the second end to move along the axis between a first position contacting the shaft tip and a second position spaced from the shaft tip, while the toy top is spinning, in a normal state, when the axis is perpendicular to a contact surface, the shaft tip protrudes from the annular member downward, and only the shaft tip contacts the contact surface, but when the axis of the shaft part inclines with respect to the contact surface, the shaft tip and the annular member contact the contact surface, and when the annular member contacts the contact surface, the annular member moves up toward the support member along the axis of the shaft part.

6. The toy top according to claim 5, wherein a connecting shaft extends between the body and the shaft tip, and the annular member includes a central opening that receives in sliding relation the connecting shaft.

7. The toy top according to claim 5, further comprising:

a biasing member positioned between the body and the annular member to urge the annular member toward the first position.

8. The toy top according to claim 7, wherein the biasing member is a coil spring.

9. The toy top according to claim 5, further comprising:

a weight on the annular member to urge the annular member toward the first position.

10. The toy top according to claim 5, wherein the shaft tip includes a contact member.

11. The toy top according to claim 10, wherein the contact member is formed in a shape of one of a hemispherical arc, a cone or a bar.

12. The toy top according to claim 5, wherein, when the annular member is in the first position, both the shaft tip and the annular member contact the surface.

13. The toy top according to claim 5, wherein, when the annular member is in the second position, only the shaft tip contacts the surface.

14. The toy top according to claim 9, wherein the weight is removable and replaceable with another weight.

15. The toy top according to claim 6, wherein the connecting shaft has an odd or polygonal cross section and the central opening is square-shaped to prevent rotation of the annular member relative to the connecting shaft.

16. The toy top according to claim 6, wherein the connecting shaft has a circular cross section and the central opening is circle shaped to allow rotation of the annular member relative to the connecting shaft.

17. A toy top for spinning on a surface and having a first end and a second end and an axis of rotation, comprising: a body at the first end, a projection extending from and non-movably fixed to the body toward the second end and having an axis that coincides with the axis of rotation, a top tip non-movably connected to the projection at the second end, an annular member positioned between the top tip and the body in sliding relation on the projection to move along the axis of the projection between a first position away from the body and toward the top tip and a second position closer to the body than the first position; while the toy top is spinning, in a normal state, when the axis of the projection is perpendicular to a contact surface, the top tip protrudes from the projection downward, and only the top tip contacts the contact surface, but when the axis of the projection inclines with respect to the contact surface, the top tip and the annular member contact the contact surface, and when the annular member contacts the contact surface, the annular member moves up along the projection along the axis of the projection.

18. The toy top according to claim 17, further comprising:

a spring positioned between the body and the annular member to urge the annular member toward the first position.

19. The toy top according to claim 17, further comprising:

a weight on the annular member to urge the annular member toward the first position.

20. The toy top according to claim 17, wherein, when the annular member is in the first position, both the top tip and the annular member contact the surface.

21. The toy top according to claim 17, wherein, when the annular member is in the second position, only the top tip contacts the surface.

22. The toy top according to claim 19, wherein the weight is removable and replaceable with another weight.

23. The toy top according to claim 6, wherein the annular member cannot rotate about the axis on the connecting shaft.

24. The toy top according to claim 6, wherein the annular member can rotate about the axis on the connecting shaft.

* * * * *